US006132163A

United States Patent [19]

Andrews et al.

[11] Patent Number: 6,132,163

[45] **Date of Patent: *Oct. 17, 2000**

[54] BOOM ARM LINKAGE MECHANISM

[75] Inventors: Charles David Andrews, Loudon; Gordon Edward Miller, Lenoir City, both of Tenn.; Leslie Harold Schult, Waseca, Minn.; Andrew Edward Modzik, Jr., Knoxville, Tenn.

[73] Assignee: Deere & Company, Moline, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/953,495

[22] Filed: Oct. 17, 1997

[51] Int. Cl.[7] ..... E02F 3/28

[52] U.S. Cl. ..... 414/685; 414/686; 414/700

[58] Field of Search ..... 414/680, 685, 414/686, 700

[56] References Cited

U.S. PATENT DOCUMENTS

| | | | |
|---|---|---|---|
| D. 322,792 | 12/1991 | Park | D15/25 |
| D. 376,372 | 12/1996 | Little et al. | D15/23 |
| 3,837,417 | 9/1974 | Little | 180/6.48 |
| 4,055,262 | 10/1977 | Baner et al. | 214/140 |
| 4,355,946 | 10/1982 | Wykhuis et al. | 414/707 |
| 4,385,863 | 5/1983 | Minor | 414/699 |
| 4,699,560 | 10/1987 | Ostermeyer et al. | 414/696 |
| 4,705,449 | 11/1987 | Christianson et al. | 414/68.5 |
| 4,878,713 | 11/1989 | Zanetis | 299/39 |
| 4,892,155 | 1/1990 | Wanamaker | 172/199 |
| 5,106,257 | 4/1992 | Braud et al. | 414/718 |
| 5,169,278 | 12/1992 | Hoechst et al. | 414/685 |
| 5,470,190 | 11/1995 | Bamford et al. | 414/686 |
| 5,511,932 | 4/1996 | Todd et al. | 414/685 |
| 5,518,358 | 5/1996 | Aschroft et al. | 414/685 |
| 5,520,500 | 5/1996 | McIlwain et al. | 414/685 |
| 5,542,814 | 8/1996 | Ashcroft et al. | 414/786 |
| 5,551,826 | 9/1996 | Todd et al. | 414/685 |
| 5,609,464 | 3/1997 | Moffitt | 414/700 |

*Primary Examiner*—Donald W. Underwood

[57] ABSTRACT

A loader linkage having a bucket and boom arm mounted to the loader vehicle by way of top and bottom links, the top link being pivotally coupled with a structural member of the vehicle that extends upwardly from the vehicle frame generally at the rear of or behind the operator station. The top link is coupled to the structural member at a point generally above and behind the operator seated on the vehicle. The linkage establishes a bucket path that extends generally vertically initially and that then extends forwardly through the entire range of upper motion of the bucket. The linkage causes the bucket to achieve maximum reach at the bucket's maximum height. The orientation of the top link also reduces the vehicles tendency to tilt rearwardly onto the rear wheel's during leveling operations.

14 Claims, 4 Drawing Sheets

BOOM ARM LINKAGE MECHANISM

This invention relates to loader vehicles and the linkage systems which couple a bucket and boom arm with the loader vehicle.

It is known to provide skid steer loader vehicles with a bucket and boom arm which is coupled to the vehicle for raising and lowering the bucket. The bucket and boom arm can be manipulated by an operator for scooping materials into the bucket and loading the scooped materials into a truck or other container. To load the contents of the bucket into a truck, the operator manipulates controls to raise the boom arm, which causes the bucket at the front of the boom arm to be raised above the edge of the truck or container. The operator can then manipulate controls for tilting the front edge of the bucket downwardly for dumping the contents of the bucket into the truck.

A first type of loader system is commonly referred to as a radial lift system. This type of loader provides a boom arm having a rear portion which is pivotally coupled directly to the rear portion of the vehicle. The bucket is operatively coupled to the front portion of the boom arm. The rearward portion of the boom arm is coupled with the vehicle for pivotal motion, and the boom arm will therefore swing an arc about its pivotal connection with the vehicle as the operator manipulates the controls for lifting the boom arm. The bucket, coupled with the front portion of the boom arm therefore also swings an arc as the boom arm swings upwardly. This type of system is commonly referred to as a radial lift system and has the advantage of having relatively simple construction since the connection of the boom arm with the vehicle is relatively simple.

Radial lift systems tend to have the disadvantage of establishing an arcuate path that the bucket and boom arm swing through as the bucket is raised. In other words, as the operator manipulates the controls to lift the boom arm and bucket, the boom arm and bucket swing upwardly in a curved path about the pivotal connection of the boom arm with the vehicle. The bucket tends to swing forwardly and upwardly during its initial range of upward motion. This forward component of initial motion of the bucket can be problematic when scooping materials if the operator wishes to lift the bucket vertically during the scooping or digging operation.

Also, when the operator wishes to load the contents of the bucket into a truck or other container from a lowered bucket position, the operator will lift the bucket which tends to swing forwardly during an initial range of motion. The operator will therefore have to begin this lifting operation at a distance remote from the container or truck so that the bucket does not swing forwardly and strike the truck or container during its initial range of motion. In the bucket's upper range of motion whereat the bucket is high enough to be above the edge of the truck or other container during the loading process, the bucket and boom arm continue to swing in their curved path about the pivotal connection of the boom arm to the vehicle. Therefore, in the upper range of motion, the bucket will be swinging upwardly and rearwardly with respect to the skid steer loader vehicle. This rearward component of motion during the bucket's upper range of motion shifts the bucket rearwardly and generally away from the truck into which the materials are to be dumped. This requires the operator to perform the additional task of driving the vehicle forwardly to position the bucket over the truck or container for unloading the bucket.

As stated earlier, radial lift loaders lift the bucket in an arc about the boom arm's pivotal connection with the vehicle. Therefore the bucket will swing forwardly during an initial range of upward motion, then achieve its forward-most position somewhere in the middle of the bucket's range of motion, and then will swing rearwardly during its upper range of motion. The vehicle is most unstable when the full bucket is at its furthest location forward of the vehicle. Therefore, radial lift loader vehicles tend to achieve their most unstable configuration when the bucket is lifted about half way up. Therefore, even though the vehicle may be capable of lifting a heavy object, the vehicle may become so unstable when the bucket is raised half way up that the operator senses the vehicle's instability and must lower the bucket to the ground. Since the bucket could only be lifted part of the way up to the edge of the truck or container, the vehicle is unable to load the contents of the bucket into the truck or container. These vehicle's are therefore often incapable of loading heavy loads up into trucks or other containers even though the loader vehicle is capable of lifting the heavy loads.

Another type of loader system is commonly referred to as a vertical lift system. This type of system includes a bucket coupled to the forward portion of a boom arm, and a linkage system couples the rearward portion of the boom arm to the vehicle. A lift mechanism such as a hydraulic cylinder typically extends between the vehicle and the boom arm for lifting the boom arm between its various positions. The linkage system of vertical lift loader vehicles include top and bottom links which extend between the vehicle and the rear portion of the boom arm. The top and bottom links function to lift the boom arm generally vertically when the hydraulic cylinder is initially actuated, and therefore these systems are commonly referred to as vertical lift loaders. Some vertical lift loaders shift the bucket rearwardly as the bucket is lifted through its initial range of motion, and therefore the operator is not required to drive the vehicle rearwardly to avoid striking the truck or container with the bucket as he begins to raise the bucket. The bucket simply travels in a path that avoids striking the truck with the bucket, and operation of this type of loader can therefore be relatively simple. The rearward shifting of the bucket during its initial range of motion off the ground can be problematic, since the rearward shifting can cause the bucket to loose its grip beneath large objects being lifted or tilted upwardly. Some conventional vertical lift loaders swing the bucket rearwardly as the bucket travels upwardly. If the bucket swings rearwardly far enough, the operator will be required to drive the vehicle forwardly for positioning the bucket directly over the truck bed into which the contents of the bucket are to be dumped. Also, the buckets of many vertical lift loaders tend to achieve a forward-most position somewhere in the middle of the bucket's vertical range of motion, and therefore as the vehicle lifts a load the vehicle may become unstable before the bucket can reach a height high enough to dump its load into a truck or other container.

Conventional skid steer loader vehicles can also be used to level areas of granular material such as soil or sand. The operator will lower the bucket to the ground and allow the boom arm to swing downwardly under its own weight by releasing the pressure from the hydraulic cylinder which lifts the boom arm. With the pressure released from the lift cylinder, the boom arm and bucket will press downwardly against the ground under their own weight. The operator will then drive the vehicle rearwardly which causes the bucket to be dragged across the surface of the soil. The bucket is allowed to float as it is dragged rearwardly, which causes the soil to be generally leveled. However, some skid steer loader vehicles have the disadvantage of causing the vehicle front tires to lift off the ground during this leveling operation. The boom arms of some loader vehicles are coupled with the vehicles such that when the pressure is released from the hydraulic lift cylinder and the boom arm and bucket swing downwardly under their own weight during the leveling operation a portion of the weight of the boom arm and bucket is transmitted to the vehicle via the top and bottom links. The remainder of the weight of the boom arm and bucket is transmitted to the ground at the point of contact between the bucket and ground. In many conventional skid steer loaders, the amount of weight transferred to the vehicle is great enough and directed in such a way that the vehicle will tilt rearwardly onto its rear wheels. Some such loader vehicles can actually lift the front wheels off the ground during the leveling operation. When this occurs, the weight of the entire vehicle is being transmitted to the ground through two locations: the bottom surface of the bucket and the rear wheels. As the operator drives the vehicle rearwardly during leveling operations in this manner, the bucket transmits a large amount of force to the ground and tends to dig downwardly into the ground surface and generally does not float on the surface of the soil as intended. Furthermore, the vehicle is difficult to maneuver when tilted back onto the rear wheels. Also, the operator station tilts rearwardly with the vehicle, which places the operator in an awkward, undesirable position.

Therefore, many operators perform leveling operations by driving the vehicle rearwardly while simultaneously accurately controlling the position of the bucket by manipulating the controls in the operator station. In other words, the bucket is not allowed to float across the surface of the soil, but rather the operator controls the precise location of the bucket as he drives the vehicle rearwardly. Such fine manipulation of the controls can be difficult for the operator to accomplish and leveling of the ground surface can be somewhat inaccurate when this procedure is used.

Therefore, it would be desirable to provide a vertical lift loader mechanism having a bucket path which does not cause the bucket to swing forwardly into a truck during an initial range of upward motion, and that does not require the operator to drive the vehicle forwardly to position the bucket over the truck for dumping the bucket into the truck. It would be desirable for such a loader mechanism to not become unstable before the bucket is high enough to dump its contents into a truck or other container. It would also be desirable for such a lift system to provide a float feature that allows the operator to properly level a ground surface by driving the vehicle in a reverse direction with no pressure being applied to the vehicle's hydraulic lift system. It would be desirable for such a lift system to reduce or eliminate the tendency of the vehicle to tilt rearwardly onto the rear wheels during the leveling operations.

SUMMARY OF THE INVENTION

The present invention provides a skid steer loader of the vertical lift type which includes a bucket, boom arm and top and bottom links which are coupled with the vehicle. A post or structural member extends upwardly from the vehicle frame at the rear of or behind the vehicle operator station. The post defines an upper portion of the vehicle to which the upper portion of the top link is pivotally coupled at a location generally above and behind the operator seated in the operator station. The lower portion of the top link is pivotally coupled with the rear portion of the boom arm.

The top and bottom links according to the present invention act to cause the bucket to be raised generally vertically during the bucket's initial range of upward motion. Therefore the bucket will not be pulled out from under large objects as the bucket is first lifted. The vertical path of the bucket during its initial range of upward motion also allows the bucket to be raised while the vehicle is proximate a truck without requiring the operator to back up to avoid striking the truck with the rising bucket.

According to the present invention, as the bucket continues traveling upwardly the top and bottom links cause the bucket to shift forwardly during the bucket's entire upper range of motion. Therefore the bucket will naturally shift outwardly over a truck as the bucket is lifted through its upper range of motion, and the operator is not required to drive the loader vehicle forwardly to position the bucket over the truck for dumping. According to the present invention, the bucket reaches its maximum forward position at maximum bucket height. Therefore, if the vehicle is capable of lifting a load, the operator will probably be able to lift the bucket and load upwardly into a truck since the bucket does not shift forwardly substantially until the bucket approaches its uppermost position.

The top link according to the present invention is coupled to the post generally behind and above the operator seated in the operator station. The connection point of the top link to the vehicle is therefore positioned further to the rear than top link connection points of prior art vertical lift linkages. The connection point of the top link to the post at this location allows the top link according to the present invention to be oriented more vertically than prior art top links. Since the top link is more vertically oriented, the force transmitted to the vehicle via the top link during leveling operations is generally reduced. Since the force transmitted to the vehicle through the top link is relatively small, the vehicle is less apt to tilt rearwardly up onto its rear wheels during leveling operations. Also, the force in the top link according to the present invention is directed along a line that extends closer to the point of contact between the rear wheels and the ground, which is the relevant pivot point of the vehicle when performing leveling operations. Therefore, the moment arm established by the top link of the present invention is relatively small, and the torque applied to the vehicle is also correspondingly small. The vehicle's tendency to tilt rearwardly about the rear wheels is therefore reduced by the orientation of the top link of the present invention which establishes a smaller moment arm with respect to the pivot point of the vehicle.

DETAILED DESCRIPTION OF THE PREFERRED EMBODIMENT

Figure 1:
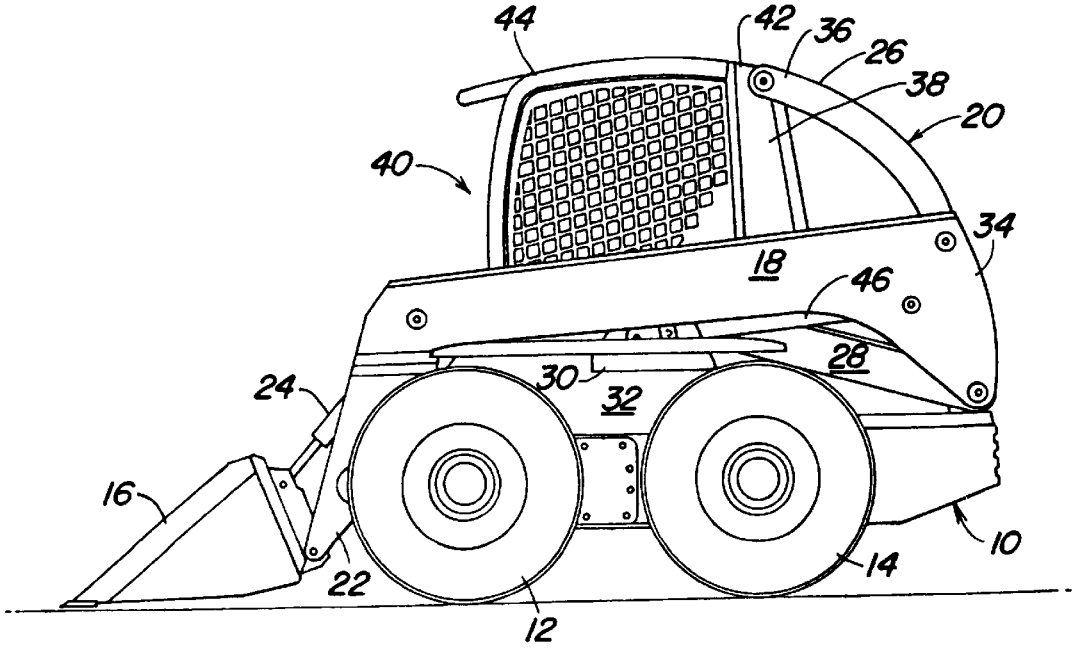
FIG. 1 is side view of a skid steer loader according to the present invention with the bucket in a lowered position in contact with the ground.

Referring now to FIGS. 1–4, there is shown the preferred embodiment of the present invention. A skid steer loader vehicle 10 is provided having front and rear driven wheels 12 and 14. The vehicle 10 is steered as the operator manipulates controls to drive the wheels on the right or left side of the vehicle 10 at different speeds to thereby steer the vehicle 10 in conventional skid steer fashion. The vehicle 10 is provided with a tool or loader bucket 16 coupled with a pair of boom arms 18 positioned on each side of the vehicle 10, which in turn are coupled with the vehicle 10 by way of a linkage mechanism 20. The loader bucket 16 is pivotally coupled to the forward portion 22 of the boom arms 18, and a bucket tilt hydraulic cylinder 24 extends between the bucket 16 and the boom arms 18 for controlling the tilted orientation of the bucket 16 with respect to the boom arms 18. By actuating the tilt cylinder 24 the operator can tilt the bucket 16 for dumping the contents of the bucket 16.

The boom arms 18 and linkage mechanism 20 which couples the boom arms 18 to the vehicle 10 are generally identical on both the left and right sides of the vehicle 10. Therefore, only the structure on the left side of the vehicle 10 will be described in detail below.

The boom arm 18 is coupled with the vehicle 10 by way of the linkage mechanism 20 which includes top and bottom link members 26 and 28. The bottom link member 28 extends between a middle portion 30 of the vehicle frame 32 and a rear portion 34 of the boom arm 18. The top link member 26 is also pivotally coupled to the rear portion 34 of the boom arm 18 and extends upwardly and forwardly therefrom. The upper portion 36 of the top link member 26 is pivotally mounted to a structural member or post 38 which forms part of the vehicle 10 and extends upwardly from the main frame portion 32 of the vehicle 10. The post 38 is mounted with the vehicle frame 32 toward the rear of or behind the vehicle operator station 40. The upper portion of the post 38 serves as an upper and rearward portion of the vehicle 10 to which the top link 26 is pivotally attached. A beam member (not shown) extends between the top portion 42 of the right and left posts 38. The operator station 40 includes an operator's seat and controls which are manipulated by the seated operator for driving and steering the vehicle 10 and for operating the loader bucket 16 and boom arm 18. A roll over protection structure or ROPS 44 is mounted to the post 38 and vehicle frame 32 for helping protect a seated operator in the event that the vehicle 10 rolls over. The ROPS structure 44 can be pivoted upwardly to provide access to vehicle compartments beneath the seat as described in greater details in co-pending U.S. patent application entitled Operator Enclosure, having Ser. No. 08/954,290, now U.S. Pat. No. 5,941,330, which is incorporated herein by reference. The ROPS 44 is pivotally mounted with the upper portion 42 of the post 42. The floor portion and seat of the operator station 40 are fixed with the ROPS structure 44 such that the seat and floor portion pivot upwardly with the ROPS 44.

Cross members can be provided which extend laterally across the vehicle 10 between the right and left top links 26 for generally rigidifying and stabilizing the linkage 20 as the linkage 20, boom arm 18 and bucket 16 are lifted. Such a cross member can be positioned to extend between the right and left top links 26 at point J shown in FIG. 4. Additional cross members could also be provided at other locations on the top links 26.

Figure 2:
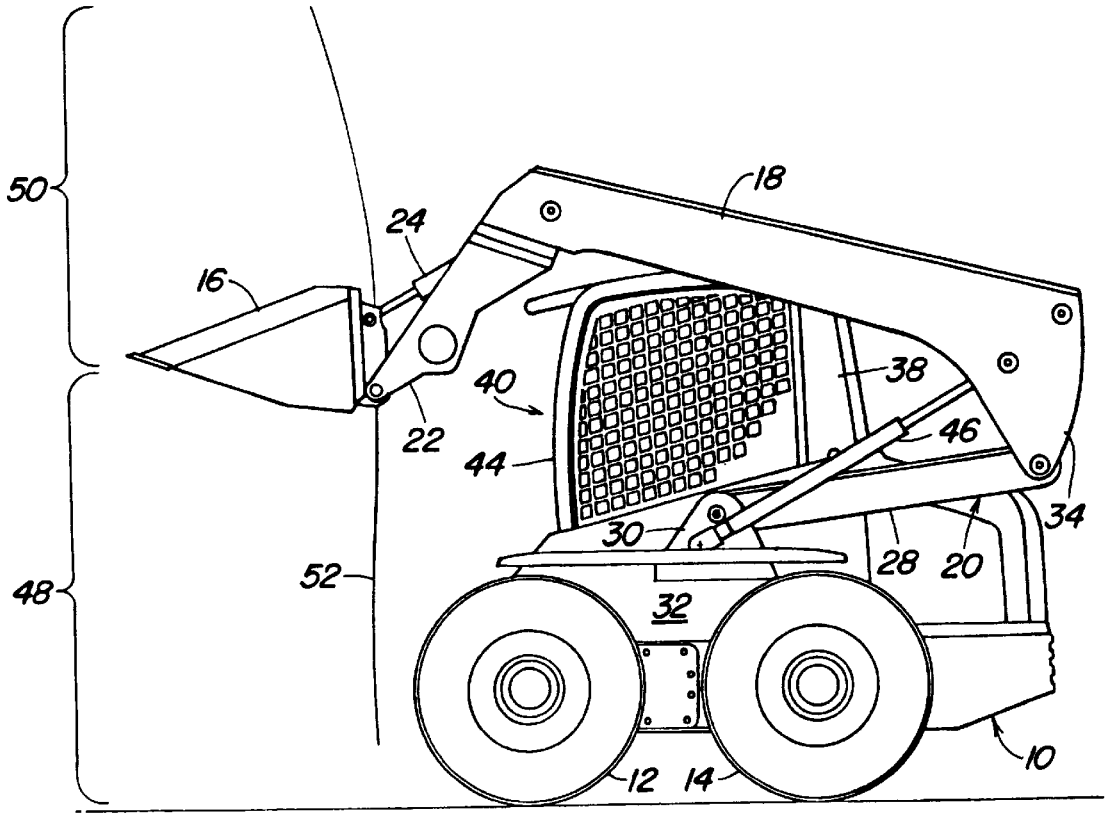
FIG. 2 is a side view of the skid steer loader of FIG. 1, showing the bucket raised to an intermediate position.
Figure 3:
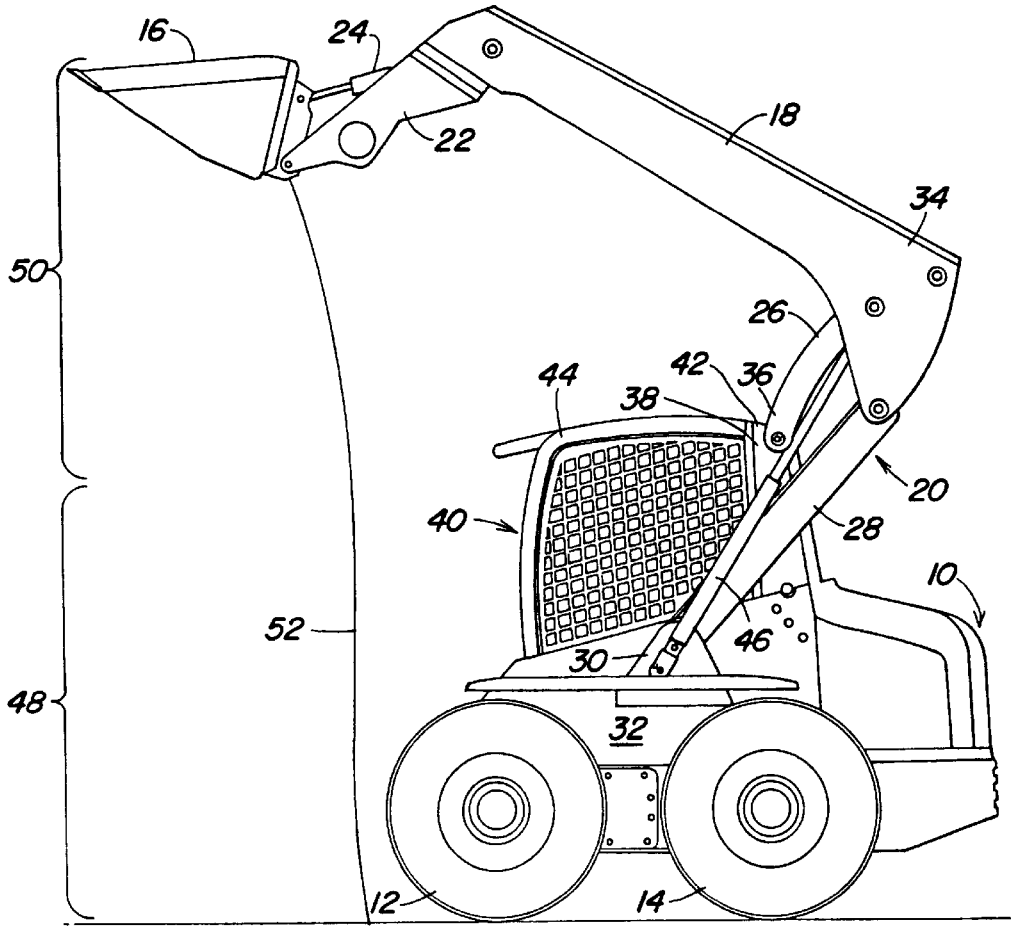
FIG. 3 is a side view of the skid steer loader according to the present invention showing the bucket raised to its maximum height.

A lift mechanism or hydraulic lift cylinder 46, as best seen in FIGS. 2 and 3, extends between the frame 32 of the vehicle 10 and the rear portion 34 of the boom arm 18. The operator can manipulate controls to extend the lift cylinder 46 for raising the boom arm 18 and bucket 16. To lower the boom arm 18 and bucket 16 the operator manipulates the controls for retracting the hydraulic lift cylinder 46. When the operator extends the lift cylinder 46 and lifts the boom arm 18, the top and bottom links 26 and 28 serve to generally guide the bucket 16 in a generally vertical path during the bucket's initial range 48 of upward motion. As the bucket 16 shifts upwardly through its upper range of motion 50 beginning about half way up, the top and bottom links 26 and 28 guide the bucket 16 and boom arm 18 upwardly and forwardly as the bucket shifts upwardly.

Since the bucket 16 shifts upwardly generally vertically during its initial range of motion 48, the operator is not required to back away from a truck or other container into which he is loading the contents of the bucket 16. The bucket 16 is automatically lifted generally vertically during its initial range of motion 48 such that the operator is not required to manipulate additional vehicle controls for moving the bucket 16 vertically during digging operations. When the bucket 16 travels upwardly through its upper range of motion 50 the bucket 16 and boom arm 18 shift upwardly and forwardly, which causes the bucket 16 to extend out over the truck or other container into which the operator wishes to dump the contents of the bucket 16. Therefore, the operator is not required to drive the vehicle 10 forwardly or perform additional vehicle controls in order to position the bucket 16 above the truck or container into which the contents of the bucket 16 are to be loaded. The bucket path 52 established by the present invention allows the operator to manipulate the bucket 16 in a desired way and in relatively simple fashion without requiring a large number of manipulations of numerous controls.

During the bucket's upper range of motion 50, the bucket 16 shifts forwardly continuously as the bucket 16 is raised. The bucket 16 does not achieve its forward-most position or maximum reach until it reaches its maximum height, as depicted in FIG. 3. Therefore, the loader vehicle 10 will tend not to become unstable when the bucket 16 is partially raised to an intermediate height, and the vehicle 10 is capable of lifting a load over the edge of a truck before the bucket reaches its forwardmost position.

Next, the advantages associated with the use of the linkage mechanism 20 according to the present invention when performing leveling operations will be described in greater detail. To perform leveling operations, the operator will release substantially all pressure from the hydraulic lift cylinder 46, which causes the bucket 16 to press downwardly against the ground under the weight of the bucket 16 and the boom arm 18. The operator can then drive the vehicle 10 rearwardly which drags the bucket 16 across the ground, leveling the surface of the ground as the vehicle 10 moves rearwardly. The bucket 16 is free to float up and down as the vehicle 10 moves rearwardly since there is substantially no pressure placed in the hydraulic lift cylinder 46. This free float feature allows the bucket 16 to smooth the surface of the ground such that the surface generally corresponds with the existing contours of the ground.

With substantially no pressure present in the hydraulic lift cylinder 46, the weight of the bucket 16 and boom arm 18 is supported at three locations: the point of contact H between the bucket 16 and the ground, the point M at which the bottom link 28 is coupled with the boom arm 18, and the point J at which the top link 26 is coupled with the boom arm 18. The portion of the weight of the boom arm 18 and bucket 16 which is borne by the top and bottom links 26 and 28 is transmitted to the vehicle frame 32. These forces are imparted to the vehicle 10 at the locations K and L where the top and bottom links 26 and 28 are coupled with the vehicle 10. The force of the weight of the boom arm 18 and bucket 16 borne by the bottom link 28 is transmitted to the vehicle 10 at the point L at which the bottom link 28 is coupled with the vehicle 10, and is oriented in a direction aligned with the bottom link 28 along lines B and B'. The force of the weight of the boom arm 18 and bucket 16 borne by the top link 26 is transmitted to the vehicle 10 at the location K whereat the top link 26 is coupled with the post 38. This force is directed along a line C which intersects the connection points J and K of the top link 26 with the post 38 and boom arm 18.

Figure 4:
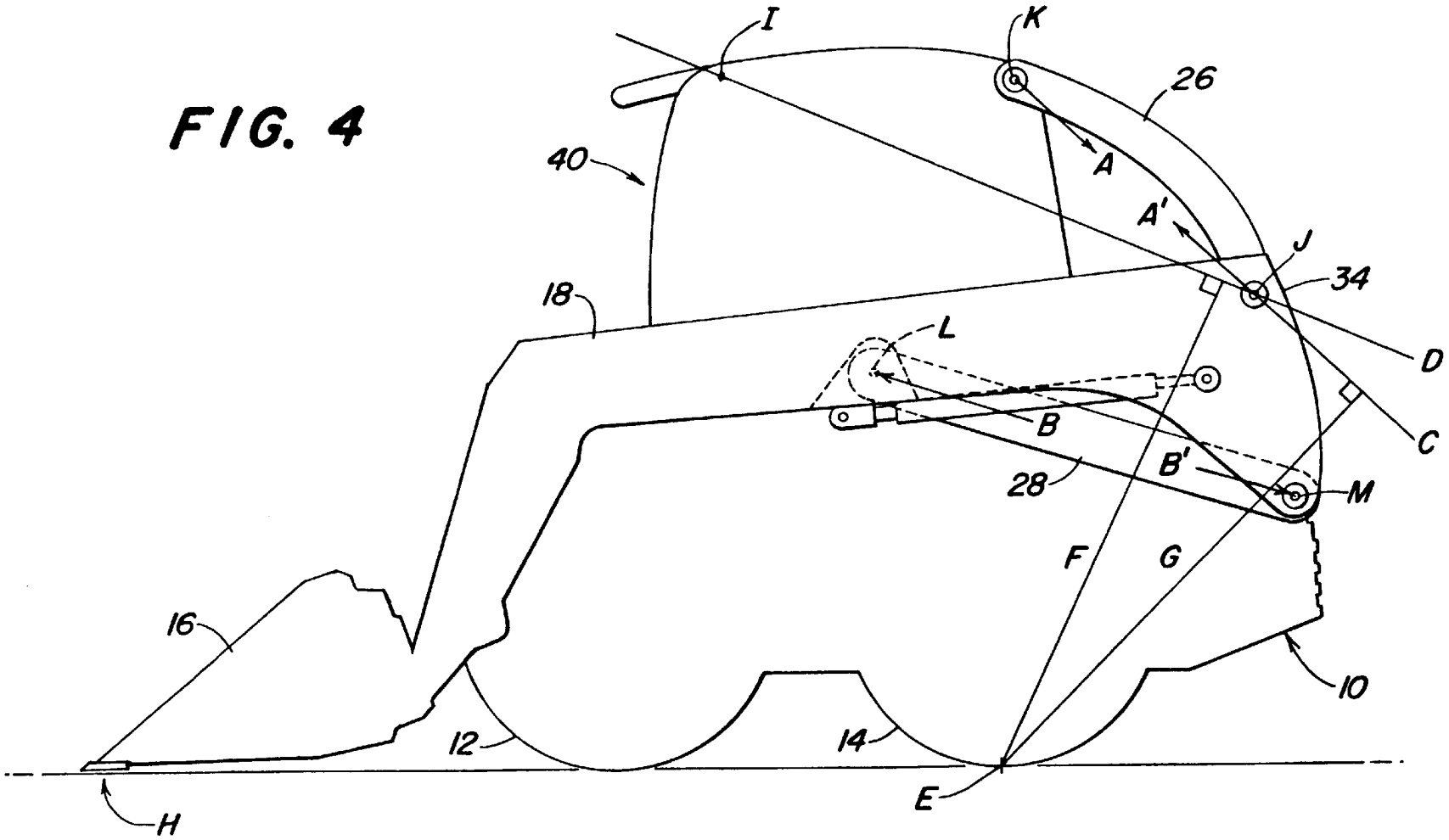
FIG. 4 is a schematic side view of the skid steer loader according to the present invention with the bucket shown in a lowered position, and showing schematically the forces encountered by various elements of the vehicle when the bucket is at rest on the ground during a leveling operation.

FIG. 4 shows an illustration of various forces at play according to the present invention when performing leveling operations. Typical prior art vertical lift loaders provide a top link that is coupled with the vehicle at approximately point I. U.S. Pat. No. 5,542,814 is an example of such a loader. The top links of these prior art loaders typically extend between approximately point I as seen in FIG. 4 and the rear portion of the boom arm proximate point J. During leveling operations the prior art top link must support a portion of the weight of the boom arm and bucket. The top links of prior art loaders tend to encounter a tensile force during leveling operations. The tensile forces in the prior art top link are then transmitted to the vehicle at point I. The forces transmitted to the vehicle at point I tend to urge the vehicle to swing clockwise about pivot point E, and can cause the vehicle to tilt rearwardly onto the rear wheels. The force applied to the vehicle at point I establishes a torque expressed as the magnitude of the force acting through point I times that force's distance F from the pivot point E, which is the point of contact between the rear tire and the ground. The present invention establishes a connection point between the top link 26 and the vehicle 10 at point K which is substantially rearward of the prior art connection point I. The line C represents the direction of the tensile force encountered by the top link 26 according to the present invention. The line C is therefore also the direction at which the force A is applied to the vehicle 10 at point K. This force A, which is directed along line C, extends closer to the pivot point E than does the prior art force which acts through point I along line D. In other words, distance G is smaller than distance F, and therefore line C is closer to point E than is line D. Therefore the moment arm G established by the present invention associated with force A in the top link is smaller than the moment arm F established by the prior art force acting through point I. This results in a torque applied by the force A according to the present invention which is less than the torque applied by the prior art linkage, and the vehicle's tendency to tip is correspondingly reduced.

Furthermore, the magnitude of force A according to the present invention is less than the force applied through the prior art connection point I. The top and bottom links 26 and 28 must support a portion of the weight of the boom arm 18 and bucket 16 when performing leveling operations. As the top link's angular orientation becomes more vertical as it is changed from point I (whereat prior art top links would extend approximately 70 degrees from vertical) to point K (whereat the top link 26 according to the present invention extends approximately 50 degrees from vertical), the tensile force in the top link 26 decreases. As the tensile force in the top link 26 decreases, the force A transmitted to the vehicle 10 also correspondingly decreases, and therefore the force A applied to the vehicle 10 is less than the force applied to the vehicle 10 at point I by the prior art. Since the magnitude of the force A applied to the vehicle 10 by the top link 26 of the present invention is less than that applied to a vehicle by prior art top links, the amount of torque transmitted to the vehicle 10 associated with the top link 26 is correspondingly reduced by the present invention. The top link 26 according to the present invention therefore has less tendency to cause the vehicle 10 to tilt rearwardly onto its rear wheels 14 than does prior art loader systems. The vehicle 10 is therefore more readily adapted to keep its front wheels 12 on the ground during rearward travel as leveling operations are performed.

FIG. 4 is a schematic view of the vehicle 10 showing many of the forces as play during the leveling operation. The boom arm 18 and bucket 16 are shown as a single member in FIG. 4 since they will generally act as such to a large extent during leveling operations. The force arrows A and A' are directed along line C and represent the tensile force experienced by the top link 26. The force arrow A represents the force transmitted from the top link 26 to point K of the vehicle 10, which is the top portion 42 of the post 38.

The force arrow A' represents the force transmitted from the top link 28 to the point J of the boom arm 18. The force arrows B and B' represent the compression force experienced by the bottom link 28. The force arrow B also represents the force transmitted from the bottom link 28 to point L of the vehicle 10. Force arrow B' represents the force transmitted from the bottom link 28 to the point M of the boom arm 18.

During leveling operations when a portion of the weight of the bucket 16 and boom arm 18 are supported by the top and bottom link 26 and 28, the top link 26 will be in tension and the bottom link 28 will be in compression. As the angular orientation of the top link 26 is changed from a more horizontal orientation of the prior art toward the more vertical orientation according to the present invention, the tensile force in the top link 26 will decrease, and the compressive force in the bottom link 28 will correspondingly decrease. The compressive force B in the bottom link is transmitted to the vehicle at point L. The force B is oriented such that it will tend to apply torque to the vehicle 10 for urging the vehicle in a counterclockwise direction about point E, and therefore acts to press the front wheels 12 against the ground. When the connection point K is utilized, the compressive force B will decrease from that of the prior art, which means the force B will press the front wheels 12 against the ground with less force than does the prior art. However, when the top link's connection point is changed from point I to point K, the tensile force A decreases at such a greater rate than does the force B that the net effect is the vehicle's front wheels 12 have a greater tendency to remain on the ground during leveling operations.

Assignment

The entire right, title and interest in and to this application and all subject matter disclosed and/or claimed therein, including any and all divisions, continuations, reissues, etc., thereof are, effective as of the date of execution of this application, assigned, transferred, sold and set over by the applicant(s) named herein to Deere & Company, a Delaware corporation having offices at Moline, Ill. 61265, U.S.A., together with all rights to file, and to claim priorities in connection with, corresponding patent applications in any and all foreign countries in the name of Deere & Company or otherwise.

What is claimed is:

1. A lift linkage system coupled with a vehicle, comprising:

a linkage coupled with the vehicle, a boom arm operatively coupled with the linkage, a tool operatively coupled with the boom arm, a lift mechanism operatively supported by the vehicle and operatively coupled with the boom arm, said lift mechanism being selectively controlled by an operator for lifting the boom arm and tool, an operator station mounted with the vehicle in which an operator is positioned during operation of the vehicle, a structural member extending upwardly from a frame of the vehicle, said structural member being positioned generally behind the operator positioned in the operator station and extending upwardly from the frame of the vehicle, a pivot mounting located on a part of the structural member behind and above the operator, and said linkage comprising a top link pivotally coupled to the pivot mounting, said top link member extends downwardly and rearwardly therefrom to the top link's pivotal connection with a rear portion of said boom arm when the boom arm is in a lowered position.

2. The invention of claim 1, wherein said linkage further comprises a bottom link pivotally coupled between the vehicle frame and the boom arm.

3. The invention of claim 1, wherein said linkage further comprises a bottom link positioned beneath the top link and extends downwardly and rearwardly from a pivotal connection with the vehicle to pivotal connection with a rearward portion of the boom arm when the boom arm is in the lowered position, and wherein said boom arm and linkage causes the tool to shift upwardly in a generally vertical path during its initial range of motion.

4. The invention of claim 3, wherein said boom arm and linkage causes the tool to shift forwardly as the tool shifts upwardly through the tool's entire upper range of motion.

5. The invention of claim 1, wherein said top link extends downwardly and rearwardly from the structural member to the boom arm at an angle approximately 50 degrees from vertical, when the boom arm is in the lowered position.

6. The invention of claim 4, wherein said tool achieves a forward-most position at a maximum height of the tool.

7. The invention of claim 1, and the lift mechanism comprising a hydraulic cylinder operatively extending between the vehicle frame and the boom arm, said hydraulic cylinder being extendable for lifting the boom arm and bucket thereattached.

8. The invention of claim 7, wherein said linkage further comprises a bottom link positioned beneath the top link and extends downwardly and rearwardly from a pivotal connection with the vehicle to a pivotal connection with a rearward position of the boom arm when the boom arm is in the lowered position, and wherein said boom arm and linkage causes the tool to shift upwardly in a generally vertical path during its initial range of motion.

9. The invention of claim 8, wherein said boom arm and linkage causes the tool to shift forwardly as the tool shifts upwardly through the tool's entire upper range of motion.

10. The invention of claim 9, wherein said tool achieves a forward-most position when the tool achieves maximum height.

11. The invention of claim 10, wherein said top link extends downwardly and rearwardly from the structural member to the boom arm at an angle approximately 50 degrees from vertical.

12. The invention of claim 7, wherein said top link extends downwardly and rearwardly from the structural member to the boom arm at an angle approximately 50 degrees from vertical when the boom arm is in the lowered position.

13. The invention of claim 8, wherein said top link extends downwardly and rearwardly from the structural member to the boom arm at an angle approximately 50 degrees from vertical when the boom arm is in the lowered position.

14. The invention of claim 9, wherein said top link extends downwardly and rearwardly from the structural member to the boom arm at an angle approximately 50 degrees from vertical when the boom arm is in the lowered position.

* * * * *

UNITED STATES PATENT AND TRADEMARK OFFICE

CERTIFICATE OF CORRECTION

PATENT NO. : 6,132,163
DATED : October 17, 2000
INVENTOR(S) : Charles David Andrews et al.

It is certified that error appears in the above-identified patent and that said Letters Patent is hereby corrected as shown below:

Column 10,
Line 8, delete "position" and insert -- portion --.

Signed and Sealed this

Tenth Day of December, 2002

JAMES E. ROGAN
*Director of the United States Patent and Trademark Office*